US005165690A

United States Patent [19]

Kelley, Jr.

[11] Patent Number: 5,165,690

[45] Date of Patent: Nov. 24, 1992

[54] AUTOMATIC CORDLESS GOLF BALL RETURN

[76] Inventor: James A. Kelley, Jr., 6908 Barrett Rd., Falls Church, Va. 22042

[21] Appl. No.: 646,208

[22] Filed: Jan. 28, 1991

[51] Int. Cl.[5] ..... A63B 57/00

[52] U.S. Cl. ..... 273/179 C; 273/182 R; 472/88

[58] Field of Search ..... 273/179 C, 182 R, 26 A, 273/179 C; 272/3, 4; 14/69.5; 52/282

[56] References Cited

U.S. PATENT DOCUMENTS

| | | | |
|---|---|---|---|
| 1,637,407 | 8/1927 | Brumder | 273/179 C |
| 1,689,475 | 10/1928 | Brumder | 273/179 C |
| 1,789,140 | 3/1931 | Byers | 273/179 C |
| 2,944,816 | 7/1960 | Dixon | 273/26 A |
| 3,237,936 | 3/1966 | Plaint | 272/4 |
| 4,129,916 | 12/1978 | Schlesinger | 52/282 |
| 4,573,686 | 3/1986 | Nakamats | 273/179 C |

FOREIGN PATENT DOCUMENTS

| | | | |
|---|---|---|---|
| 311017 | 5/1929 | United Kingdom | 273/179 C |
| 1150685 | 4/1969 | United Kingdom | 273/182 R |

*Primary Examiner*—Theatrice Brown
*Attorney, Agent, or Firm*—Dickstein Shapiro & Morin

[57] ABSTRACT

An automatic ball return for practicing golf putting includes a ramp that receives the putted ball, converts the energy of the rolling ball into vertical movement up the ramp, and then through gravity, rolls the ball back down the ramp towards the user. Two legs attached to the ramp are interlocked when the device is in use to provide the proper contour to the ramp, and disengage so the legs and ramp lie flat when the device is to be stored or transported. The ramp includes a target on each end, and the device may be positioned with either leg along the ground allowing either target to be used.

15 Claims, 2 Drawing Sheets

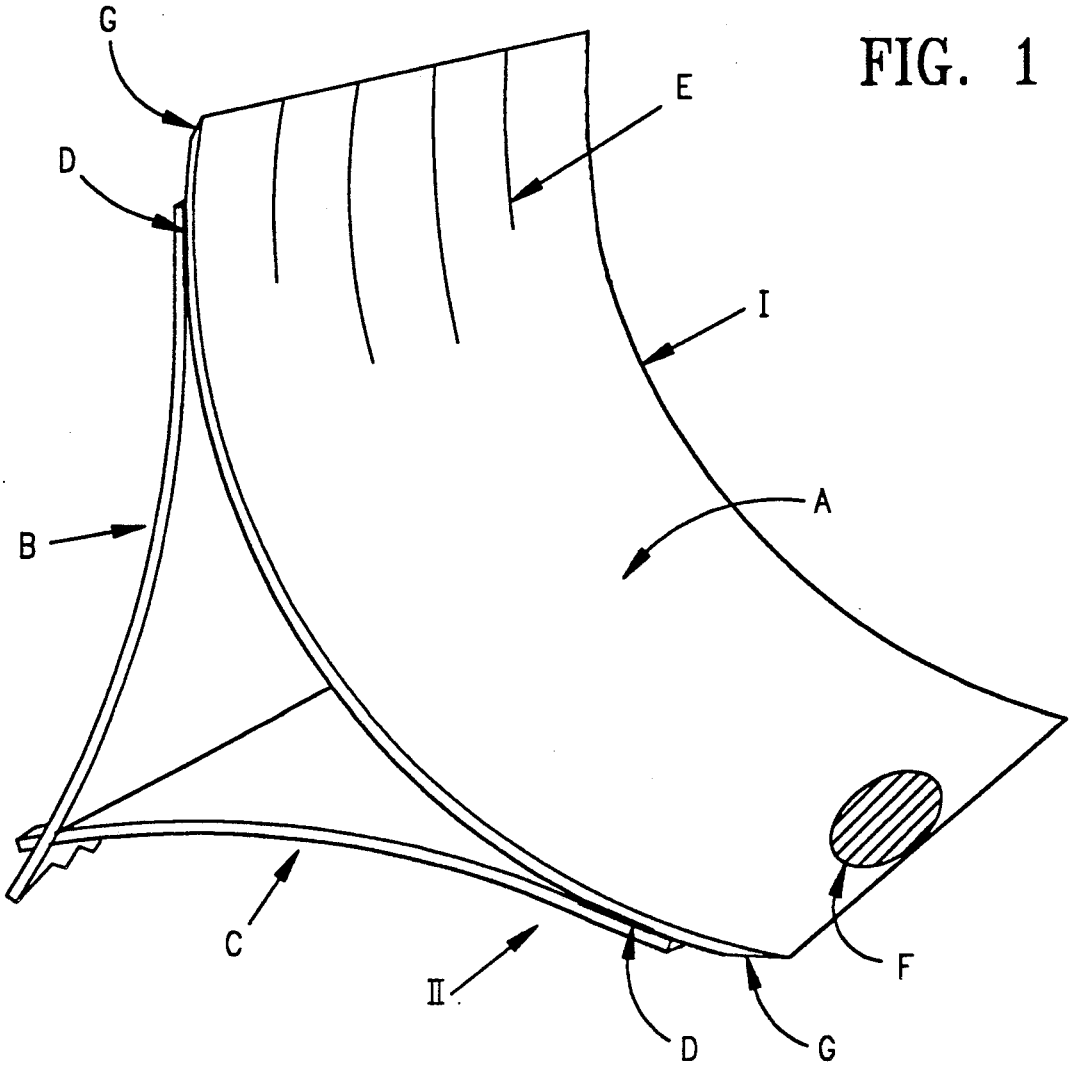
FIG. 1
FIG. 2
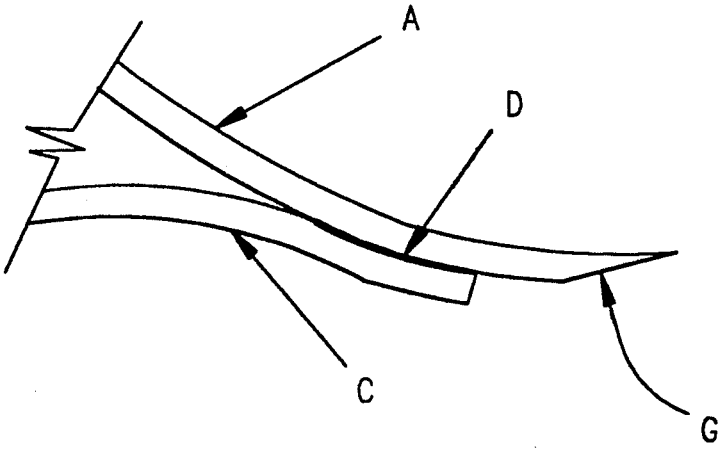

AUTOMATIC CORDLESS GOLF BALL RETURN

BACKGROUND OF THE INVENTION

The present invention relates to a device used in practicing the putting portion of the game of golf.

It is known that the accuracy of the putting portion of the game of golf is paramount to a successful low golf score. It is also known that practicing putting will develop successful performance on the greens and therefore lower scores. It is easy to demonstrate the importance of putting to a successful game by observing that half the strokes on a typical par 4 hole are intended to be accomplished on the putting green. More noteworthy is the fact that on the typical par 3, 67% of the strokes are to be on the green as putts.

There exists a problem in the unavailability of practical opportunities to practice putting when not on the course so that performance on the green is improved. Numerous other putting practice devices have been developed but none have all the important aspects that make for an effective, versatile and convenient putting practice device. This new invention allows for the practice of putting with minimal walking, effort, or wasted time. Conventional putting devices require electricity to return the ball, or have a hole to receive the ball but do not return the ball to its original starting position; this produces a certain amount of inefficiency. Most devices are narrow and if the ball misses the device the ball wall not be returned.

SUMMARY AND OBJECTS OF THE INVENTION

These shortcomings of the prior art are alleviated by the present invention. In one aspect of the invention, a golf ball return to be placed on a playing surface is provided, having a ramp with two ends for receiving a putted ball, and a support for the ramp which selectively positions one of the ramp ends to receive the ball. The support has two legs, one attached to each end of the ramp, and the other ends of the legs are attached to each other, so that the ramp and two legs are in a generally triangular configuration. The ramp ends are beveled to lie effectively flush against the playing surface. The ramp ends also each have a target, one is an elliptical shape representing a golf hole, the other is a set of lines.

In another aspect of the present invention, a golf ball return is provided, having a ramp to receive and return the putted ball and a support configured to position the ramp to receive the ball while in a working position, and for positioning the ramp so the golf ball return is effectively flat while in a stored position. There are two legs affixed to the ends of the ramp and the legs are engaged to each other in the working position, and disengaged from each other to lie flat against the ramp in the stored position. The legs can be engaged by locking tabs in one leg into slots in the other.

In yet another aspect of the present invention, a golf ball return is provided having a flexible ramp for receiving the ball and a support to bend the ramp to the desired contour. The support has two legs attached to the ramp which bend the ramp when the ends of the legs are interlocked. The legs are also flexible, and the golf ball return lies substantially flat when the legs are disengaged from each other and lie against the ramp.

In still another aspect of the present invention, a golf ball return is provided with a gripping means to securing the return to the playing surface. The golf ball return has a ramp for receiving the putted ball, two legs attached to the ramp to support it, and the legs are interlocked at their ends away from the ramp. There are teeth or tabs on the ends of the legs away from the ramp to grip into the playing surface.

It is an object of this invention to allow one to practice putting repeatedly without having to retrieve the ball that does not go into the cup.

It is another object of this invention to provide a means for practicing putting that is effective, that is versatile, and that is convenient. The ball will return to its starting position automatically, the device operates without electricity, there are no mechanical parts to break or wear out the unit is easily unfolded to lie flat and fit into the average suitcase or briefcase for travel or storage.

It is yet another object of this invention to provide a means for the entertainment and relaxation that comes from the practice of putting as a diversion from the pressures of the work day.

Other objects and advantages of the present invention will be readily apparent from the following description and drawings.

BRIEF DESCRIPTION OF THE DRAWINGS

FIG. 1 is a perspective view of a golf ball return according to a preferred embodiment of the present invention in its working position.

FIG. 2 is a view in the direction of arrow II of FIG. 1 showing the glued joint and shaved corner.

DETAILED DESCRIPTION OF A PREFERRED EMBODIMENT

Refer now to FIG. 1, there being shown a golf ball return according to a preferred embodiment of the present invention generally designated by reference letter (I). The golf ball return includes a curved ramp (A) which is designed to receive an incoming putted ball, convert the energy of the rolling ball into vertical movement up the ramp, and then use the ramp and gravity to roll the golf ball back down the ramp and toward the individual putting. The golf ball return includes a vertical leg (B), and a horizontal leg (C), both of which are plastic-welded to the ramp by means of a solvent glue (D). The free ends of the legs are notched (H) and (J) to engage and interlock with each other to provide a secure connection between the legs. When folded into the working position bending and interlocking the legs (B) and (C) curves the ramp (A) to the desired contour. The legs lock into one another at the ends (H) and provide a secure ball return device with the proper curvature and stability to receive and return the ball. The tabs of the interlocked legs also securely hold the device to the carpet, grass, or other like surface to prevent slipping when the putted ball strikes the ramp (A). The outside surface of the ramp (A) is imprinted with an elliptical imprint (F) on one end which simulates a golf ball hole, and the other end is imprinted with longitudinal lines (E) for putting or game alignment. The leading edge (G) of each end of the ramp is shaved such that the ramp will fit tightly against the floor or carpet practice surface. The device may be placed either with leg (C) along the ground so that the simulated golf hole is the target, or with leg (B) along the ground so the game alignment marks are the target.

Refer now to FIG. 2, wherein is shown a view in the direction of arrow II. Leg (C) is attached at one end to ramp (A) at solvent glue bond joint (D). The plastic sheet forming ramp (A) is shaved to a bevel at (G) so ramp (A) fits substantially flush against the grass o carpet when the ball return is in its working position. Leg (B) is attached in a like manner to the other end of ramp (A).

Figure 3:
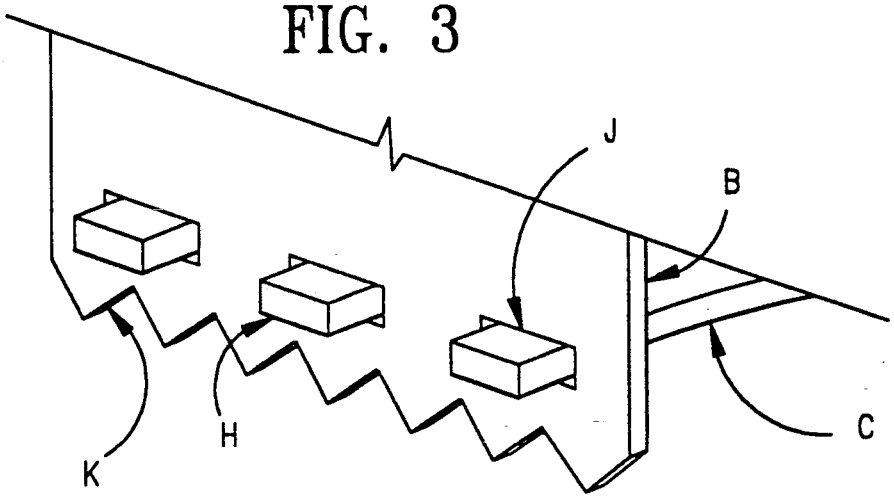
FIG. 3 is a partial perspective view of the golf ball return of FIG. 1 showing the ends of legs (B) and (C) interlocked in the working position.

Refer now to FIG. 3, wherein is shown a perspective view of the ends of the legs (B) and (C) interlocked in the working position. Tabs (H) on leg (C) are inserted into slots (J) in leg (B). Teeth or tabs (K) are formed on the end of leg (C).

Figure 4:
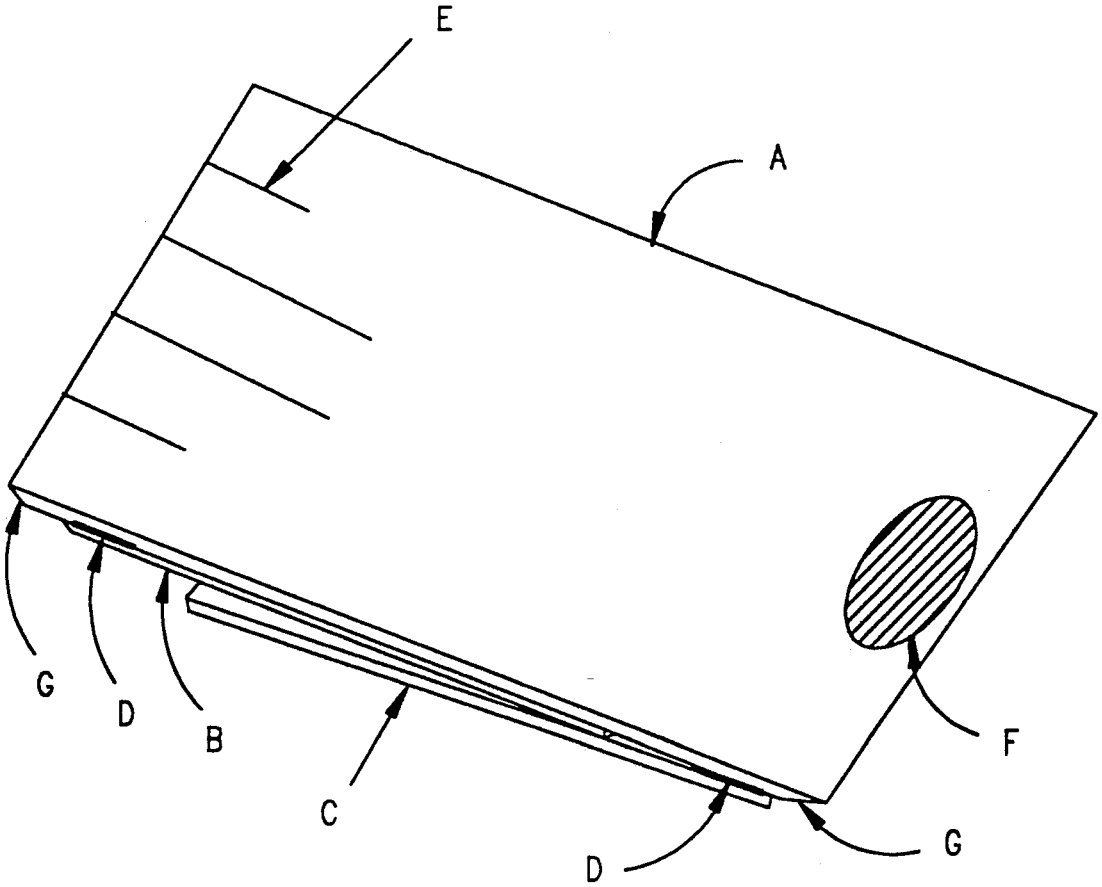
FIG. 4 is perspective view of the golf ball return of FIG. 1 in its stored position.

Refer now to FIG. 4, wherein is shown a perspective view of the golf ball return folded in its stored position. At one end of ramp (A) is glued one end of leg (B). At the other end of ramp (A) is glued one end of leg (C). Legs (B) and (C) are sized and positioned to lie flat against each other and against ramp (A) which is flat when the golf ball return is in its stored position. The free ends of legs (B) and (C) are not interlocked at their tabs when in the stored position.

It is found that the objects of this invention are well met when the ramp (A) is approximately 11 inches wide by 15 and one-half inches long, the legs (B) and (C) are approximately the same width as ramp (A), and legs (B) and (C) are sufficiently shorter than ramp (A) to allow the legs to fit against one another and the ramp when in the stored position. Other dimensions will also work, this invention is not limited to the above dimensions.

The above description and drawings are only illustrative of a preferred embodiment which achieves the objects, features and advantages of the present invention, and it is not intended that the present invention be limited thereto. Any modifications of the present invention which comes within the spirit and scope of the following claim is considered part of the present invention.

What is claimed as new and desired to be protected by Letters Patent of the United States is:

1. A device to be placed on a playing surface for returning a golf ball putted on the playing surface, comprising:

a ramp adapted to receive and return a golf ball putted on a playing surface; and support means permanently affixed to said ramp for supporting said ramp, for positioning said ramp to receive the ball while said device is in a working position, and for positioning said ramp so said device is substantially flat while in a stored position;

wherein said support means includes a first leg having a first end affixed to a first end of said ramp, a second leg having a first end affixed to a second end of said ramp, and an engaging means for releasably engaging a second end of said first leg to a second end of said second leg for positioning said device in said working position;

wherein at least one of said legs are sized to lie substantially flat against each other and said ramp while said legs are disengaged from each other and said device is in said stored position;

wherein said engaging means includes tabs on said second end of said first leg;

wherein said engaging means further includes slots on said second end of said second leg sized to be engaged by said tabs on said first leg.

2. A device as in claim 1, wherein said two first and second ramps ends are each adapted to receive a putted golf ball;

each of said ramp ends being positionable on a playing surface so as to allow a putted golf ball to roll onto said ramp in a direction toward the other ramp end; and wherein said support means is adapted to support said ramp at an incline with respect to the playing surface and for supporting one of said ends of said ramp for receiving putted golf ball to roll up the inclined ramp toward the other ramp end.

3. A device as in claim 2, wherein said second end of said first leg is attached to said second end of said second leg, so that said ramp, first leg, and second leg are in a generally triangular configuration.

4. A device as in claim 3, wherein at least one of said first ramp end and said second ramp end is beveled to allow said ramp end to lie substantially flush against the playing surface.

5. A device as in claim 4, wherein said ramp includes at least one target symbol positioned on at least one of its ends.

6. A device as in claim 5, wherein said at least one target symbol includes a first target symbol positioned on said first ramp end and a second target symbol positioned on said second ramp end.

7. A device as in claim 6, wherein said first target symbol is elliptical and said second target symbol is a plurality of lines.

8. A device as in claim 1, wherein said ramp, first leg, and second leg are flexible.

9. A device as in claim 1, further comprising gripping means for securing said device to the playing surface.

10. A device as in claim 9, wherein said gripping means includes teeth sized, shaped, and positioned to engage the playing surface to resist movement of said device.

11. A device to be placed on a playing surface for returning a golf ball putted on the playing surface, comprising:

a flexible ramp for receiving and returning a golf ball putted on a playing surface; and support means for supporting said ramp and for bending said ramp to a desired contour;

wherein said support means includes a first leg having a first end affixed to a first end of said ramp, a second leg having a first end affixed to a second end of said ramp, and engaging means for releasably engaging a second end of said first leg to a second end of said second leg thereby bending said ramp to said desired contour; and wherein said engaging means includes tabs on said second end of at least one of said legs and slots on said second end of the other of said legs, said slots sized to be engaged by said tabs.

12. A device as in claim 11, wherein at least one of said legs is flexible.

13. A device as in claim 12, wherein said tabs are held into said slots by tension in at least one of said ramp and said legs.

14. A device as in claim 13, wherein said legs are affixed to said ramp with a solvent adhesive.

15. A device to be placed on a playing surface for returning a golf ball putted on the playing surface, comprising:

a ramp adapted to receive and return a golf ball putted on a playing surface; and support means permanently affixed to said ramp for supporting said ramp, for positioning said ramp to receive a ball while said device is in a working position, and for positioning said ramp so said device is substantially flat while in a stored position;

wherein said support means includes a first leg having a first end affixed to a first end of said ramp, a second leg having a first end affixed to a second end of said ramp, and an engaging means for releasably engaging a second end of said first leg to a second end of said second leg for positioning said device in said working position;

wherein said engaging means further includes tabs on said second end of said first leg and slots on said second end of said second leg sized to be engaged by said tabs on said first leg.

* * * * *